US006810845B1

(12) United States Patent
Plenzler et al.

(10) Patent No.: US 6,810,845 B1
(45) Date of Patent: Nov. 2, 2004

(54) LUBRICATION SYSTEM USING VALVES TO MEET VARIOUS ENGINE OIL PRESSURE REQUIREMENTS

(75) Inventors: Jeremy M. Plenzler, Royal Oak, MI (US); Liyun Zheng, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/666,748

(22) Filed: Sep. 18, 2003

(51) Int. Cl.[7] ..... F01M 1/06

(52) U.S. Cl. ..... 123/90.33; 123/90.16; 123/90.17; 123/90.34; 123/196 R

(58) Field of Search ..... 123/90.15, 90.16, 123/90.17, 90.18, 90.27, 90.31, 90.33, 90.34, 90.38, 196 R, 196 CP, 198 C; 184/6, 6.9

(56) References Cited

U.S. PATENT DOCUMENTS 5,143,034 A * 9/1992 Hirose ..... 123/196 R
5,220,891 A * 6/1993 Nakamura et al. ..... 123/90.16
RE35,382 E * 11/1996 Saito ..... 123/90.27
5,964,198 A * 10/1999 Wu ..... 123/196 R

* cited by examiner

*Primary Examiner*—Thomas Denion
*Assistant Examiner*—Ching Chang
(74) *Attorney, Agent, or Firm*—Karl F. Barr, Jr.

(57) ABSTRACT

A lubrication system for an internal combustion engine having valves to optimize oil flow through an engine to increase engine efficiency. The lubrication system includes an engine driven oil pump connected to supply pressurized oil through a main oil feed to a main bearing gallery, a cam gallery, a cam phaser and switching valve lifters. A pair of pressure increasing valves connected to the main bearing gallery and the cam gallery selectively restrict oil flow to the cam gallery and the main bearing gallery to raise oil pressure supplied to the cam phaser. A pressure regulator valve is connected to the cam gallery to control oil pressure supplied to the switching lifters for cylinder deactivation or stepping valve train operation. The optimization of oil flow allows the engine to use a smaller oil pump and thereby increase engine efficiency while providing for actuation of the cam phaser or the switching lifters over the full engine speed range.

11 Claims, 4 Drawing Sheets

LUBRICATION SYSTEM USING VALVES TO MEET VARIOUS ENGINE OIL PRESSURE REQUIREMENTS

TECHNICAL FIELD

This invention relates to engine oil systems and, more particularly, to a system including pressure valves to optimize oil flow and pressure for various lubrication and actuation functions.

BACKGROUND OF THE INVENTION

Internal combustion engines may use lubricating oil for many purposes including, for example, lubricating moving parts, actuating cam phasers, and controlling valve lifters for valve stepping and cylinder deactivation. Cam phasers and cylinder deactivation devices generally require a higher oil pressure for actuation during engine operation than the moving parts of the engine require for proper lubrication.

One approach to maximize engine efficiency is to use a smaller oil pump to provide only the minimum amount of oil pressure needed to prevent engine wear. However, smaller oil pumps do not provide enough oil pressure to actuate a cam phaser or switching lifters at low and idle engine speeds. Thus, cam phasing, valve stepping, and cylinder deactivation can only be achieved at higher engine speeds.

Another approach is to use a larger oil pump to provide enough oil pressure to operate the cam phaser or switching lifters at low engine speeds. This approach allows phasing, valve stepping, and cylinder deactivation at lower engine speeds to alter the valve timing and increase engine efficiency. However, the efficiency gains are not without cost. A higher pressure produced by larger oil pump supplies excess flow that over lubricates the moving parts of the engine and requires additional energy to drive the pump, creating parasitic losses that reduce engine efficiency.

A method is desired of selectively regulating oil pressure throughout an engine to increase engine efficiency while allowing the engine to operate a cam phaser or switching lifters at low engine speeds without having to greatly increase oil pump output.

SUMMARY OF THE INVENTION

Co-pending applications pertaining to related subject matter were filed concurrently with this application on Sep. 18, 2003 as U.S. application Ser. No. 10/666,745, U.S. application Ser. No. 10/666,864, and U.S. application Ser. No. 10/667,233.

The present invention provides an oil system for an internal combustion engine having oil pressure control valves to optimize oil pressures in the engine while increasing engine efficiency by minimizing parasitic losses created from over lubrication.

In an exemplary embodiment, the oil system includes an oil pump having an inlet and an outlet. An oil pickup connected with the inlet extends into an engine oil sump to draw oil into the oil system. The outlet of the oil pump connects to a main oil feed which supplies oil to a main bearing gallery and a cam phaser. Oil sent to the cam phaser is used to actuate the cam phaser, while oil directed to the main bearing gallery is used primarily for lubrication purposes. In addition, some of the oil pumped into the main bearing gallery is sent through a cam gallery feed to a cam gallery in an upper part of the engine for lubrication of a valve train. When switching lifters are present, some of the oil directed to the cam phaser or the cam gallery may be diverted to the switching lifters to allow valve stepping or cylinder deactivation.

A first pressure increasing valve connected between the main oil feed and the main bearing gallery has a small opening designed to provide minimal oil flow to the main bearing gallery while oil pump output is low. As oil pump output increases, the pressure increasing valve reacts by providing additional openings to allow for addition flow through the valve.

The restriction of oil flow created by the first pressure increasing valve increases oil pressure to the main oil feed and the cam phaser while the main bearing gallery operates at a lower oil pressure. This allows cam phasing at engine idle or other conditions when oil pump pressure is normally to low to actuate the cam phaser. The additional oil pressure supplied to the cam phaser allows the phaser to vary valve timing at all engine speeds without a large increase in the size of the oil pump. The use of a smaller oil pump reduces parasitic losses for increased engine efficiency.

A second pressure increasing valve connected between the main bearing gallery and the cam gallery has a small opening designed to provide minimal oil flow to the cam gallery while oil pump output is low. As oil pump output increases, the pressure increasing valve reacts by providing additional openings to allow for additional flow through the valve.

The restriction of oil flow created by the second pressure increasing valve increases oil pressure to the main bearing gallery, while the cam gallery operates at a lower oil pressure. This allows the cam gallery to operate at a lower oil pressure than the main bearing gallery to reduce engine oil demands, thereby allowing the engine to operate with a smaller oil pump to reduce parasitic losses and increase engine efficiency.

A pressure regulator valve positioned between the second pressure increasing valve and the cam gallery regulates pressure to the cam gallery to control the switching lifters for valve stepping or cylinder deactivation. When low valve step operation is desired, the pressure regulator valve maintains low oil pressure to the switching lifters. When high valve step operation is desired the pressure regulator valve maintains high oil pressure to the switching lifters to cause high valve lift. When the switching lifters are used for cylinder deactivation, the pressure regulator valve may be used to provide adequate oil pressure for cylinder deactivation or normal oil pressure for standard engine operation.

These and other features and advantages of the invention will be more fully understood from the following description of certain specific embodiments of the invention taken together with the accompanying drawings.

DESCRIPTION OF THE PREFERRED EMBODIMENT

Figure 1:
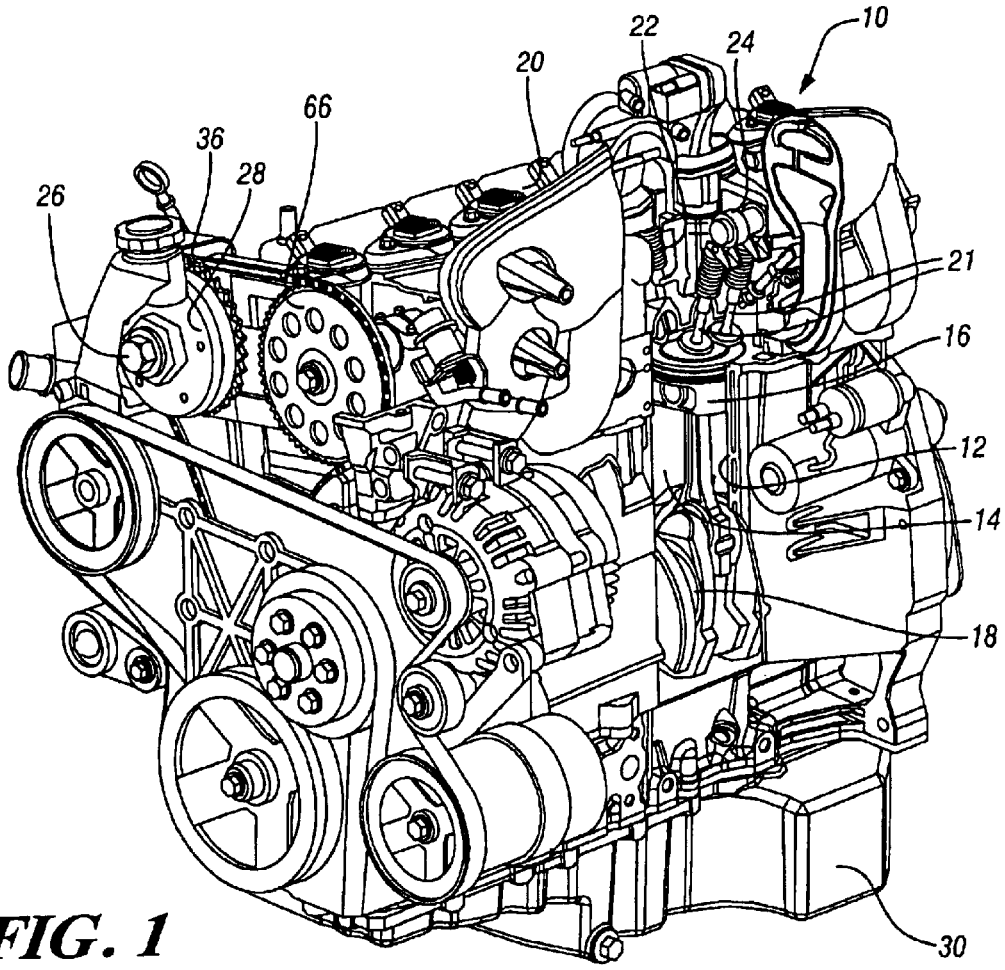
FIG. 1 is a pictorial view of an internal combustion engine including an oil system with a cam phaser according to the invention.

Referring now to FIG. 1 of the drawings in detail, numeral 10 generally indicates an internal combustion engine. The engine includes a cylinder block 12 having a bank of cylinders 14 containing pistons 16 connected with a crankshaft 18. A cylinder head 20 carries intake and exhaust valves 21, 22 actuated by camshafts 24, 26. A cam phaser 28 is mounted on the exhaust camshaft 26 to vary the exhaust valve timing. An oil pan 30 below the block forms an oil sump for the engine.

Figure 2:
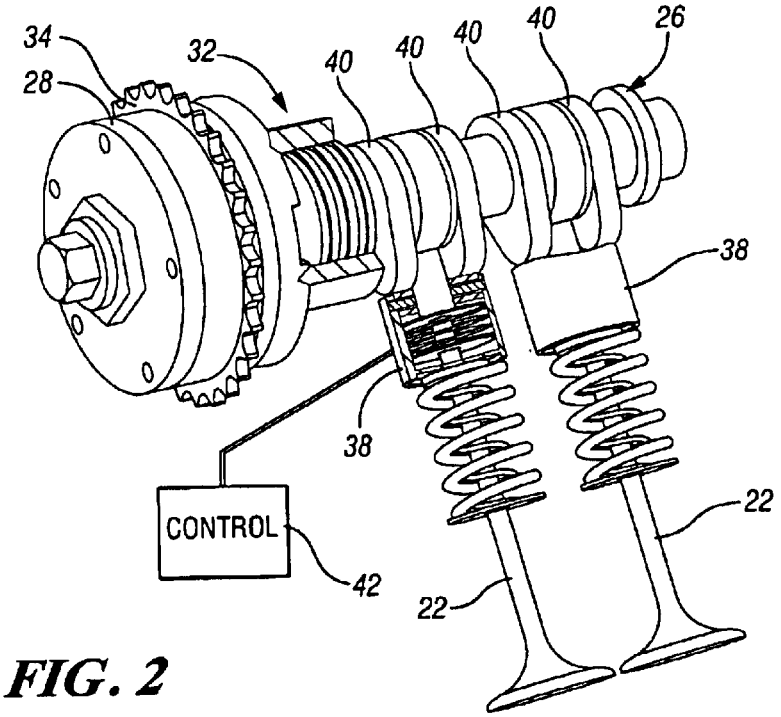
FIG. 2 is a pictorial view of a portion of a direct acting valve train with switching lifters having portions broken away to show interior features of the components.

FIG. 2 illustrates an exhaust portion of an engine valve train 32 for use in an overhead cam piston type engine. The valve train 32 includes exhaust camshaft 26 which is driven through a drive sprocket 34 connected by a chain 36 (FIG. 1) with the engine crankshaft 18. Cam phaser 28 is connected between the sprocket 34 and the camshaft 26 in order to vary the timing of the camshaft relative to the piston motion and other operating functions of the engine and relative to other camshafts of the engine.

The exhaust valves 22 are actuated through switching valve lifters 38 which are engaged by cams 40 of the camshaft 26. The switching valve lifters 38 react to oil pressure to deactivate or selectively change the amount of valve lift provided for the associated exhaust valves 22. More particularly, oil pressure supplied to the switching lifters 38 may be used to reduce valve lift or disable valve lift for cylinder deactivation.

Figure 3:
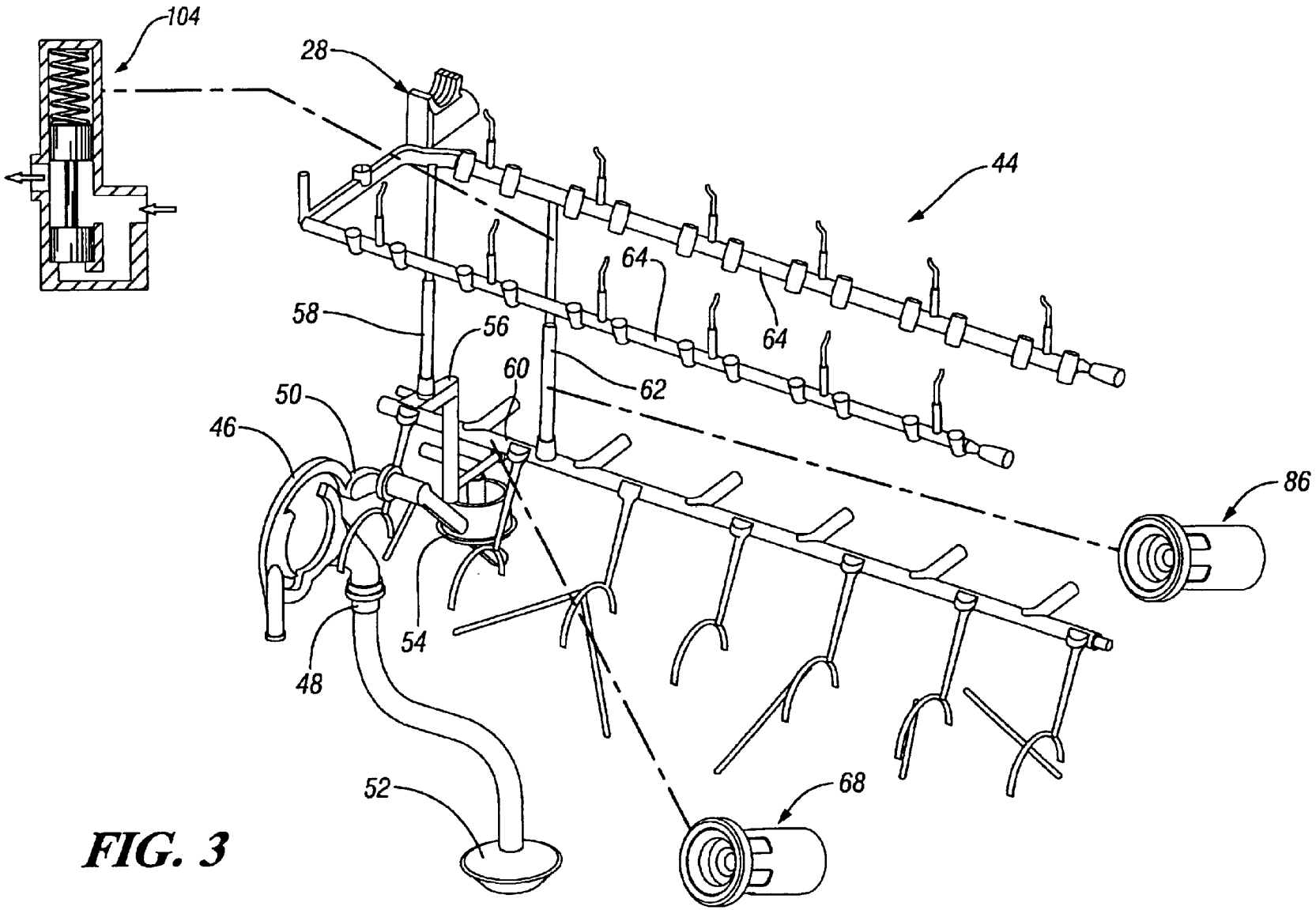
FIG. 3 is a pictorial view of an exemplary oil system for the engine of FIG. 1.

FIG. 3 illustrates the passages of an oil system 44 within the engine 10. The oil system includes an engine driven oil pump 46 having an inlet 48 and an outlet 50. An oil pickup 52 connected with the pump 46 extends into the sump of the oil pan 30. The pump 46 connects through an oil filter 54 with a main oil feed 56. The main oil feed 56 distributes oil to a cam phaser feed 58 and a main bearing gallery 60. The main bearing gallery 60 supplies oil to crankshaft main bearings and connecting rod bearings, not shown. The main bearing gallery 60 connects with a cam gallery feed 62 which carries oil to a cam gallery 64 for lubricating camshaft bearings and valve gear 66 within the cylinder head 20 of the engine 10.

Figure 4:
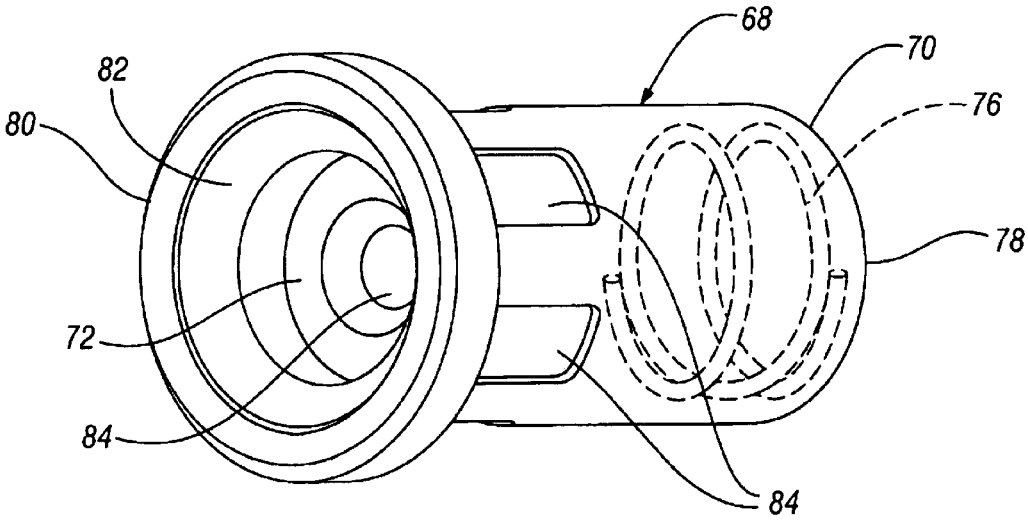
FIG. 4 is a pictorial view of a first pressure increasing valve for the oil system.

In accordance with the invention, a first pressure increasing valve 68, as shown in FIG. 4, is connected between the main oil feed 56 and the main bearing gallery 60. The first pressure increasing valve 68 has a tubular housing 70 surrounding a slidable flow control piston 72. The piston 72 internally defines an orifice 74. A biasing spring 76 between the piston 72 an outlet end 78 of the housing 70 urges the piston 72 toward an inlet end 80 of the housing, to close a large inlet opening 82 in the housing. A plurality of bypass openings 84 extend through a tubular wall of the housing 70 adjacent the inlet end 80.

Under low oil pressure conditions, the biasing spring 76 holds the flow control piston 72 against the inlet end 80 of the housing 70, closing the bypass openings 84 to only allow oil flow through the orifice 74 of the pressure increasing valve 68.

As oil pressure increases at the inlet end 80 of the housing 70, the piston 72 begins to slide toward the outlet end 78 and compress the biasing spring 76. As the piston 72 moves toward the outlet end 78, the piston allows incoming oil to flow through the bypass openings 84 to increase oil pressure to the cam gallery 64. As oil pressure on the inlet end 80 of the housing 70 is reduced, the biasing spring 76 pushes the piston 72 back toward the inlet end 80 to close the bypass openings 84 and reduce oil pressure to the cam gallery 64.

Figure 5:
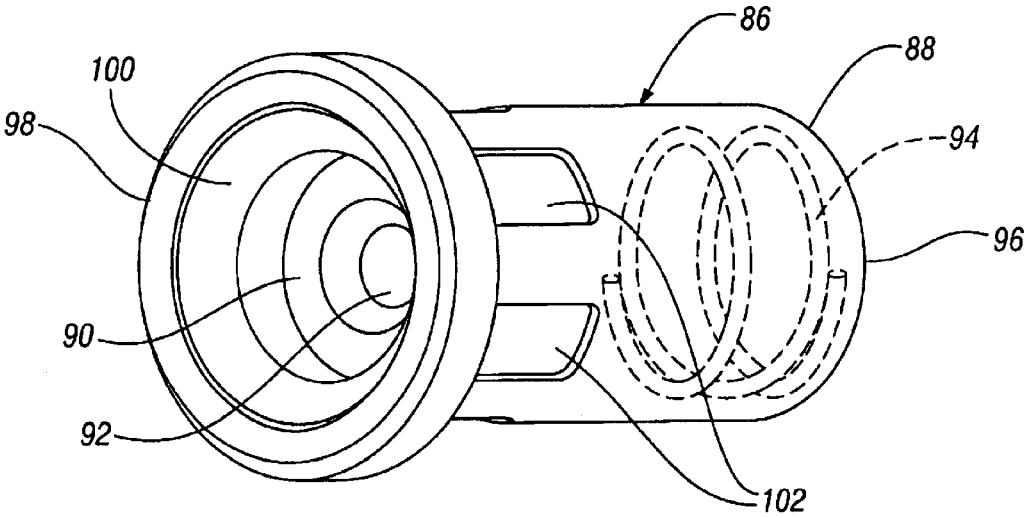
FIG. 5 is a pictorial view of a second pressure increasing valve for the oil system.

A second pressure increasing valve 86, as shown in FIG. 5, is connected between the main bearing gallery 60 and the cam gallery 64. The pressure increasing valve 86 has a tubular housing 88 surrounding a slidable flow control piston 90. The piston 90 internally defines an orifice 92. A biasing spring 94 between the piston 90 and an outlet end 96 of the housing 88 urges the piston 90 toward an inlet end 98 of the housing, to close a large inlet opening 100 in the housing. A plurality of bypass openings 102 extend through a tubular wall of the housing 88 adjacent the inlet end 98.

Under low oil pressure conditions, the biasing spring 94 holds the flow control piston 90 against the inlet end 98 of the housing 88, closing the bypass openings 102 to only allow oil flow through the orifice 92 of the pressure increasing valve 86.

As oil pressure increases at the inlet end 98 of the housing 88, the piston 90 begins to slide toward the outlet end 96 and compress the biasing spring 94. As the piston 90 moves toward the outlet end 96, the piston allows incoming oil to flow through the bypass openings 102 to increase oil pressure to the cam gallery 64. As oil pressure on the inlet end 98 of the housing 88 is reduced, the biasing spring 94 pushes the piston 90 back toward the inlet end 98 to close the bypass openings 102 and reduce oil pressure to the cam gallery 64.

Figure 6:
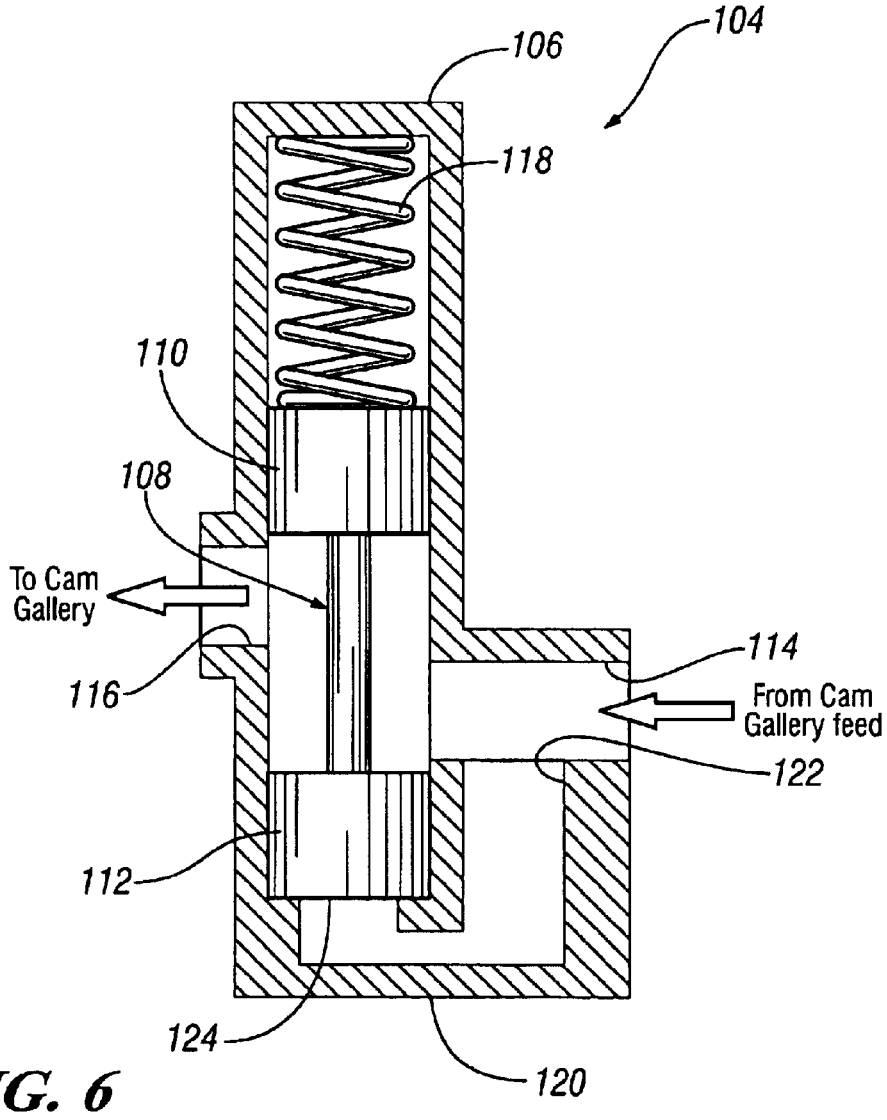
FIG. 6 is a diagrammatic view of a pressure regulator valve for the oil system.

A pressure regulator valve 104, as shown in FIG. 6,is connected between the cam gallery 64 and the pressure increasing valve ξ. The pressure regulator valve 104 has a housing 106 surrounding a piston subassembly 108 comprising first and second slidable flow control pistons 110, 112. Pistons 110, 112 are oppositely spaced and positioned adjacent an inlet 114 and an outlet 116. A biasing spring 118 positioned above the piston subassembly 108 biases the pistons 110, 112 toward the lower end 120 of the housing 106 to space the pistons away from the inlet 114 to allow maximum flow through the valve 104. Alternatively, a solenoid may be used in place of the spring 118 to control the placement of the pistons 110, 112 within the housing 106. A pressure control inlet 122 diverts a portion of the incoming oil to a lower surface 124 of the piston 112 to increase the amount of oil pressure acting upon the lower surface. As a result, the pressure lifts the piston subassembly 108 against the spring 118 causing the second piston 112 to obstruct the inlet 114 to reduce flow through the valve 104.

Referring now to FIGS. 3–6, the inlet 114 of the pressure regulator valve 104 receives oil from the cam gallery feed 62. The position of the pistons 110, 112 relative to the inlet 114 regulates the amount of oil directed through the valve 114 and to the cam gallery 64 to control the amount of oil pressure supplied to the switching lifters 38 of the valve train 32. Preferably, the pressure regulator valve 104 provides low oil pressure for low valve lift or normal valve train 32 operation and higher oil pressure as needed for high step valve train operation or cylinder deactivation.

As the incoming oil pressure to the pressure control inlet 122 increases, the piston subassembly 108 moves against the biasing spring 118 causing the second piston 112 to partially obstruct flow through the inlet 114 to maintain a predetermined maximum oil pressure to the cam gallery 64 and the switching lifters 38. As the incoming oil pressure to the pressure control inlet 122 decreases, the biasing spring system 118 moves the piston subassembly 108 toward its original position, thereby opening the inlet 114 to reduce restriction through the valve 104.

During engine operation, the oil pump 46 draws oil from the oil pan 30 through the oil pickup 52. The oil is then pumped through the pump outlet 50 and oil filter 54 to the main oil feed 56. The oil in the main oil feed 56 is then directed to the main bearing gallery 60 and the cam phaser 28. Some of the oil in the main bearing gallery 60 flows to the cam gallery 64 through the pressure increasing valve 68.

At lower engine speeds while oil pump output is minimal, only a small portion of the oil pumped though the oil system 44 flows through the orifice 74 of the pressure increasing valve 68. The remainder of the oil not flowing through the orifice 74 builds oil pressure on the inlet end 80 of the pressure increasing valve 68 which creates back pressure in the main oil feed 56 and in turn increases oil pressure to the cam phaser 28. This allows the cam phaser 28 to actuate during idle and low rpm conditions, when oil pump pressure would otherwise be too low for cam phaser actuation. This restriction of oil flow to the main bearing gallery 60 at lower engine speeds limits the system's oil flow requirements, thereby allowing the engine 10 to operate with a smaller more efficient oil pump.

A portion of the oil flowing into the main bearing gallery is pumped through the orifice 92 of the pressure increasing valve 86. The remainder of the oil not flowing through the orifice 92 builds oil pressure on. the inlet end 98 of the pressure increasing valve 86 which increases oil pressure in the main bearing gallery. This restriction of oil flow to the cam gallery feed 62 limits the system's oil flow requirements, thereby allowing the engine 10 to operate with a smaller more efficient oil pump.

The pressure regulator valve 104 regulates oil flow from the cam gallery feed 62 to the cam gallery 64 and the switching lifters 38. During low oil pressure operation, such as idle or low rpm operation, the size of the inlet 114 maintains an oil pressure to the cam gallery 64 which is optimal to cause the switching lifters 38 to operate with low valve lift.

As engine speed increases, the output from the oil pump 34 increases, causing the oil pressure in the system 32 to increase. As oil pressure increases at the inlet end 80, the piston 72 slides toward the outlet end 78 against the biasing spring 76. The movement of the piston 72 increases flow through the pressure increasing valve 68 by opening the bypass openings 84. The increased flow of oil through the pressure increasing valve 68 increases oil pressure in the main bearing gallery 60.

The increased oil pressure in the main bearing gallery 60 causes the piston 90 of the pressure increasing valve 86 slide toward the outlet end 96 against the biasing spring 94. The movement of the piston 90 increases flow through the pressure increasing valve 86 by opening the bypass openings 102. The increased flow of oil through the pressure increasing valve increases oil flow to the cam gallery feed 62.

The increased oil flow to the cam gallery feed 62 causes pressure to increase on the lower surface 124 of the piston 112, which causes the piston subassembly 108 to move upward in the housing 106 and compress the biasing spring 94. As the piston subassembly 108 moves upward, the second piston 112 restricts flow through the inlet 114 to maintain high oil pressure to the switching lifters 38 for high valve lift operation.

Alternatively, if the engine is equipped with switching lifters 38 for cylinder deactivation, cylinder deactivation may be achieved by changing the oil flow rates through the pressure regulator valve as needed so that at lower engine speeds the switching lifters 38 receive adequate oil pressure for cylinder deactivation.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A lubrication system for an internal combustion engine, the system comprising:

an oil pump driven by the engine and supplying pressurized oil through a main oil feed to a main bearing gallery, a cam gallery, and a cam phaser;

a first pressure increasing valve connected between the oil pump and the main bearing gallery and operative to selectively limit flow to the main bearing gallery and thereby raise oil pressure supplied to the cam phaser to a desired operating level greater than the oil pressure supplied to the main bearing gallery;

a second pressure increasing valve connected between the main bearing gallery and the cam gallery and operative to selectively limit oil flow to the cam gallery and thereby raise oil pressure supplied to the main bearing gallery and the cam phaser to a desired operating level greater than the oil pressure supplied to the cam gallery; and a pressure regulator valve connected between the second pressure increasing valve and the cam gallery and operative to regulate oil pressure to the cam gallery to alter valve train operation.

2. A system as in claim 1 wherein the pressure regulator valve maintains a low oil pressure to the switching lifters during engine operation for low step valve train operation.

3. A system as in claim 1 wherein the pressure regulator valve maintains a high oil pressure to the switching lifters during engine operation for high step valve train operation.

4. A system as in claim 1 wherein the pressure regulator valve provides adequate oil pressure to the switching lifters during engine operation for cylinder deactivation.

5. A system as in claim 1 wherein the first pressure increasing valve includes an open orifice limiting oil flow to the cam gallery and the main bearing gallery to maintain a desired minimum oil pressure to the cam phaser at lower engine speeds.

6. A system as in claim 1 wherein the second pressure increasing valve includes an open orifice limiting oil flow to the cam gallery to maintain a desired minimum oil pressure to the main bearing gallery and cam phaser at lower engine speeds.

7. A system as in claim 5 wherein the first pressure increasing valve maintains adequate cam phaser oil pressure during engine operation.

8. A system as in claim 6 wherein the second pressure increasing valve increases oil pressure to the cam gallery as engine speed increases.

9. A system as in claim 1 wherein the cam gallery receives oil from the main bearing gallery.

10. A system as in claim 1 including an oil pickup connected with an inlet of the pump to draw in oil from an engine oil pan.

11. A system as in claim 1 including an oil filter connected between the outlet of the oil pump and the main oil feed.

* * * * *